United States Patent [19]

Phillips et al.

[11] 4,149,586

[45] Apr. 17, 1979

[54] HEAT TRANSFER PROCESS AND APPARATUS

[75] Inventors: Colin R. Phillips, Gormley; Jose Freire-Canosa, Toronto, both of Canada

[73] Assignee: The Governing Council of the University of Toronto, Toronto, Canada

[21] Appl. No.: 879,707

[22] Filed: Feb. 21, 1978

[51] Int. Cl.[2] ..... F28C 3/16

[52] U.S. Cl. ..... 165/1; 110/245; 165/104 F

[58] Field of Search ..... 165/104 F, 1; 122/4 D; 110/245

[56] References Cited

U.S. PATENT DOCUMENTS

| | | | |
|---|---|---|---|
| 3,075,580 | 1/1963 | Davis, Jr. | 165/104 F X |
| 3,495,654 | 2/1970 | Jacubowiez | 165/104 F |
| 3,512,577 | 5/1970 | Javorsky | 165/104 F X |
| 3,921,590 | 11/1975 | Mitchell et al. | 110/245 X |
| 4,052,140 | 10/1977 | Highley | 110/245 X |

FOREIGN PATENT DOCUMENTS

| | | | |
|---|---|---|---|
| 2618290 | 12/1976 | Fed. Rep. of Germany | 110/245 |

*Primary Examiner*—Albert W. Davis, Jr.
*Attorney, Agent, or Firm*—Hirons & Rogers

[57] ABSTRACT

A specially modified and adapted fluidized bed is used for heat transfer between gas streams, which have a substantial temperature differential. The fluidized bed is provided with first and second inlet ports for the gases and first and second upper zones, in respective substantial vertical alignment with one another, with outlet ports in the upper zones. The hot gas is led in through the first inlet port and out through the first outlet port, whilst the cooler gas is led in through the second inlet port and out through the second outlet port. Particles of the fluidized bed are permitted to flow between the hot zone and the cooler zone of the fluidized bed, but no significant mixing of the two gas streams takes place in the fluidized bed. Efficient heat transfer is effected through the bed. The apparatus may be used in a heat transfer process with inert fluidized bed particles, and may also be used in the fluidized bed gasification of coal, feeding air in through the first inlet port to cause exothermic reaction with the coal, and feeding water vapour in through the second inlet for gasification of the coal. In this manner, the exothermic reaction provides heat which is transferred to maintain the endothermic reaction in coal gasification.

9 Claims, 3 Drawing Figures

HEAT TRANSFER PROCESS AND APPARATUS

FIELD OF THE INVENTION

This invention relates to heat transfer processes and apparatus, and more particularly to a novel process and apparatus for transferring heat between two gas streams, which are at different temperatures from one another.

BACKGROUND OF THE INVENTION

The need for heat transfer between gas streams arises in many industrial processes, for energy saving and heat recovery purposes. For example, heat recovery is practiced with flue gases from combustion processes for reasons of economy, so that the hot gases leaving the processes can preheat incoming gases. This is undertaken in many metallurgical processes such as smelting and blast furnace operations, where spent, discharge gas issues from the furnace at high temperature, and incoming, reactant gas is at a lower temperature, but must be hot enough to maintain the reaction temperature.

Methods currently employed for heat transfer between gas streams, at high temperatures, are inefficient. In one method, checkerwork brick recuperators are used, which are alternately heated and cooled by the discharge gas and the inlet gas respectively. Present heat recovery practices using recuperators are inefficient on account of the low heat transfer rates between the gas streams and the brick apparatus, the large volume necessary for the recuperator apparatus, the high capital cost and high maintenance cost of the recuperator.

A special case of the need for heat transfer between gases arises in the case of processes for gasification of solid carbonaceous fuel deposits such as oil shales, tar sands and coal. The gaseous fuels which are produced from coal are, basically, mixtures of carbon monoxide and hydrogen along with hydrocarbon and small amounts of carbon dioxide. Gasification of, for example, coal requires the reacting of the coal at very high temperatures with steam, so as to produce a fuel-rich gas comprising a mixture of, predominantly, carbon monoxide and hydrogen. This reaction is endothermic. To achieve the necessary high reaction temperatures (e.g. above 700° C.) and supply heat to the endothermic fuel gas producing reaction, an exothermic reaction is conducted, namely combustion of a small amount of the coal with oxygen. Heat from the exothermic reaction is then transferred to the endothermic, fuel gas producing reaction.

Some coal gasification processes currently in use involve intermittent feed of air, followed by water vapour, to the coal bed. The air causes combustion of some of the coal and raises the temperature. The subsequent feeding of water vapour produces fuel gas but at the same time causes cooling of the coal. Then air is fed through again, to raise the temperature ready for a subsequent injection of water vapour. In other coal gasification processes, mixtures of oxygen and water vapour at high temperatures are fed into the coal, so that the exothermic and endothermic reactions may proceed together. In such a mixed feed process, however, one has to use oxygen rather than air, or the fuel gas produced will be diluted with nitrogen. This adds to the expense of the process. The intermittent, cyclic process can use air, since no fuel gas is being produced when air is fed in, and the nitrogen can therefore be bled off and kept away from the fuel gas.

BRIEF DESCRIPTION OF THE PRIOR ART

The use of fluidized beds as heat transfer apparatus, in general gas-to-surface heat transfer processes, is known. A fluidized bed comprises a mass of small solid particles, the bottom of which is subjected to a rising gas stream. The particles move substantially as a fluid, due to the passage of excess gas in the form of bubbles through the bed. This causes erratic, turbulent flow of particles within the bed chamber, in the nature of a fluid. Since the fluidized particles present a very large surface area in intimate contact with the gas, fluidized beds are used for conducting chemical reactions involving gas-solids contacts, catalytic reactions and heat transfer processes.

So far as we are aware, however, previous attempts to use fluidized beds for heat transfer purposes between gas streams have involved the use of two separate but adjacent beds of fluidized particles. These prior attempts are exemplified by U.S. Pat. No. 3,075,580 Davis, in which a first central fluidized bed is surrounded by a second, annular fluidized bed, the two beds being separated by a solid, imperforate cylindrical heat transfer wall. Heat exchange between gases fluidizing the two beds takes place through the heat exchange wall. A plurality of hot and cold fluidized beds can be provided, in a grid pattern or the like, but each surrounded by a dividing heat transfer wall. At high temperatures, the heat transfer wall is susceptible to rapid corrosion, as well as deterioration due to abrasion.

U.S. Pat. No. 3,512,577 Javorsky is another example of the use of fluidized beds for heat transfer purposes between gas streams, again using two beds separated by an imperforate heat transfer wall. In such heat transfer processes, the particulate material of the bed is inert towards either the hot gas or the cold gas.

It is also known to employ fluidized beds in the gasification of coal. In such processes, powdered coal itself may form the fluidized bed particles. A process in which hot gases are supplied to a fluidized bed of coal, and combustion of coal takes place in a fluidized bed of coal, is referred to in U.S. Pat. No. 2,619,451 Ogorzaly et al. In U.S. Pat. No. 2,631,921 Odell, coal gasification is disclosed as carried out in a fluidized bed containing coal admixed with a packing material, portions of the fluidized material being heated outside the fluidized bed vessel. U.S. Pat. No. 2,669,509 Sellers shows a coal gasification process using a fluidized bed of coal, in which both heating of the coal and reaction with water vapour to produce fuel gases appear to be occurring simultaneously at the same location in the bed. U.S. Pat. No. 2,689,787 Ogorzaly et al shows another fluidized bed fuel producing process in which, as applied to coal, heating of the coal takes place in a separate vessel, and the coal so heated is then fed to a vessel in which it forms a fluidized bed and interacts with oxygen and steam, to cause combustion and generate fuel gases. The high temperature combustion gases are fed to the separate heating vessel to assist in the preheating.

SUMMARY OF THE INVENTION

It is an object of the present invention to provide a new and improved heat transfer process and apparatus for use with gases.

It is a further object of the present invention to provide a novel process and apparatus for gasification of carbonaceous fuels such as coal.

According to the invention, it has been found that fluidized beds can be used as efficient heat transfer media for the transfer of heat between two gas streams of different temperatures, without the use of any physical barrier separating the fluidized particles subjected respectively to the hot and cold gas streams. According to the invention, the hot gas stream and the cooler gas stream are both fed into the bottom of the same fluidized bed, through separate ports therein, and travel upwardly through the fluidized bed. The upper part of the fluidized bed is divided by an impervious partition into first and second upper zones, with a separate outlet in each zone, the two inlets being in vertical alignment with respective ones of the first and second upper zones. It has been found that the two gas streams, although passing through the same fluidized bed, substantially maintain their individual identities, whilst moving parallel to each other in side by side, parallel zones from their respective inlets to the upper zones, through the fluidized bed. Meanwhile, the turbulence and agitation of the fluidized bed particles caused by the gas flow is sufficient to cause them to move between the two gas streams in the lower zone of the fluidized bed to transfer the heat from the hot gas stream to the cool gas stream, and thereby efficiently effect heat transfer therebetween. Heat from the hot gas stream, or from an exothermic reaction in the fluidized bed, is transferred to the cooler stream or to an endothermic reaction in the fluidized bed by radiation, conduction, convection, mixing and particle migration.

Thus according to one aspect of the present invention, there is provided a fluidized bed apparatus for effecting heat transfer between a hot gas stream and a cooler gas stream, the apparatus comprising:

a chamber for receiving therein a mass of solid particles capable of forming a fluidized bed;

a first inlet port in the lower part of said chamber, for feeding the hot gas stream therein;

a second inlet port in the lower part of said chamber for feeding the cooler gas stream therein, the first inlet port and the second inlet port having a lateral separation;

an impervious dividing member extending downwardly from the top of the chamber part way into the fluidized bed of particles and dividing the upper portion of the chamber into first and second upper zones vertically aligned respectively with the first inlet port and the second inlet port;

a first outlet port in the first upper zone; and a second outlet port in the second upper zone.

According to another aspect of the present invention, there is provided a process of effecting heat transfer between a first, hot gas stream and a second, cooler gas stream, utilizing a fluidized bed of particles, which comprises:

introducing the first gas stream into the bottom portion of the fluidized bed through a first inlet port;

introducing the second gas stream into the bottom portion of the fluidized bed through a second inlet port, said second inlet port being separated laterally from said first inlet port;

conducting the respective gas streams upwardly through respective upwardly extending communicating zones of said fluidized bed, and into respective physically separated first and second upper zones thereof, the flow rates of the gas streams being adjusted so as to maintain fluidity and turbulent flow of the particles of the fluidized bed;

extracting the first gas stream from the fluidized bed through a first exit port located in the first separated upper zone; and extracting the second gas stream from the fluidized bed through a second exit port located in the second separated upper zone.

DESCRIPTION OF THE PREFERRED EMBODIMENTS

In the use of the process purely for heat transfer purposes, the fluidized bed particles may be any suitable inert particles which do not chemically react with or deteriorate in the presence of either of the two gases or gas streams passing through the fluidized bed. The fluidized bed particles act as an inert heat transfer medium, circulating through the bed itself. Suitable such particles include particles of glass, alumina, ferric oxide, calcium oxide and various metals such as iron. In the adaption of the process of the present invention to gasification of coal, however, the fluidized bed particles are of coal optionally mixed with inert material, the first gas stream being of air or other oxygen containing gas, and the second gas stream being of water vapour. The oxygen-containing gas stream causes exothermic reaction in one part of the fluidized bed, and the heat so produced is rapidly transferred to the other gas stream of water vapour, and to the endothermic reaction caused thereby, to provide the necessary energy for the endothermic reaction to produce fuel gas. From the second upper zone substantially in line with the water vapour inlet, therefore, there is extracted via the second outlet port fuel gas in high concentrations. The fuel gas so produced is substantially non-contaminated with the residual, unused portion of the oxygen-containing feed. From the first upper zone in line with the oxygen-containing gas inlet, there issues via the first outlet port nitrogen and other air residues, perhaps mixed with small amounts of carbon dioxide produced in the process. Since the fuel gas is obtained separately and independently of the waste gases, air can be used as the oxygen containing gas, and production of pure oxygen for feed purposes is unnecessary. The coal particles are gradually consumed and automatic replenishment of them can be provided. This is in accordance with standard fluidized bed technology, to provide automatic withdrawal and replenishment of the fluidized particles to the bed.

The process and apparatus of the invention show particular utility in heat transfer between a very hot gas stream, i.e. a gas stream having a temperature at its inlet to the fluidized bed, of at least 500° C. and a cooler stream.

In general terms, the process of the invention is conducted in the same manner as standard, known fluidized bed processes. Thus, the nature and sizes of the bed particles are chosen and arranged according to known criteria. The rates of gas introduction through the inlet ports are adjusted to cause correct fluidity of the bed, whilst avoiding removal of the particles from the bed. The process can be conducted batchwise or continuously, with automatic replenishment of bed particles to the necessary extent, all according to known technology.

As noted the apparatus of the invention has a dividing means, such as a baffle plate, extending downwardly to divide the upper protion of the chamber into first and second upper zones. Movement of particles between the hot and cold gas stream locations is freely permitted below the bottom of the baffle plate but is prevented above the bottom of the baffle plate. The baffle plate should extend downwardly a distance such that its end is submerged in the fluidized bed, during its operation, thereby leaving ample free communication between the respective zones of the bed for particle circulation. The bottom of the baffle plate is preferably aligned to overlie vertically the space separating the first and second inlet ports.

For increased heat transfer efficiency, the fluidized bed according to the invention may have a plurality of first inlet ports and a dividing means forming a plurality of first upper zones in substantial vertical alignment with respective ones of the first inlet ports, and similarly a plurality of second inlet ports and second upper zones aligned therewith, arranged in a suitable grid pattern so that each first inlet port is predominantly adjacent to a group of second inlet ports, and vice versa. In such an arrangement, efficient heat transfer is obtained, since turbulent movement of hot particles in the bed in a predominant number of lateral directions is effective in causing heat transfer to a cooler area of the bed.

REFERENCE TO THE DRAWINGS

DETAILED DESCRIPTION OF THE SPECIFIC PREFERRED EMBODIMENT

Figure 1:
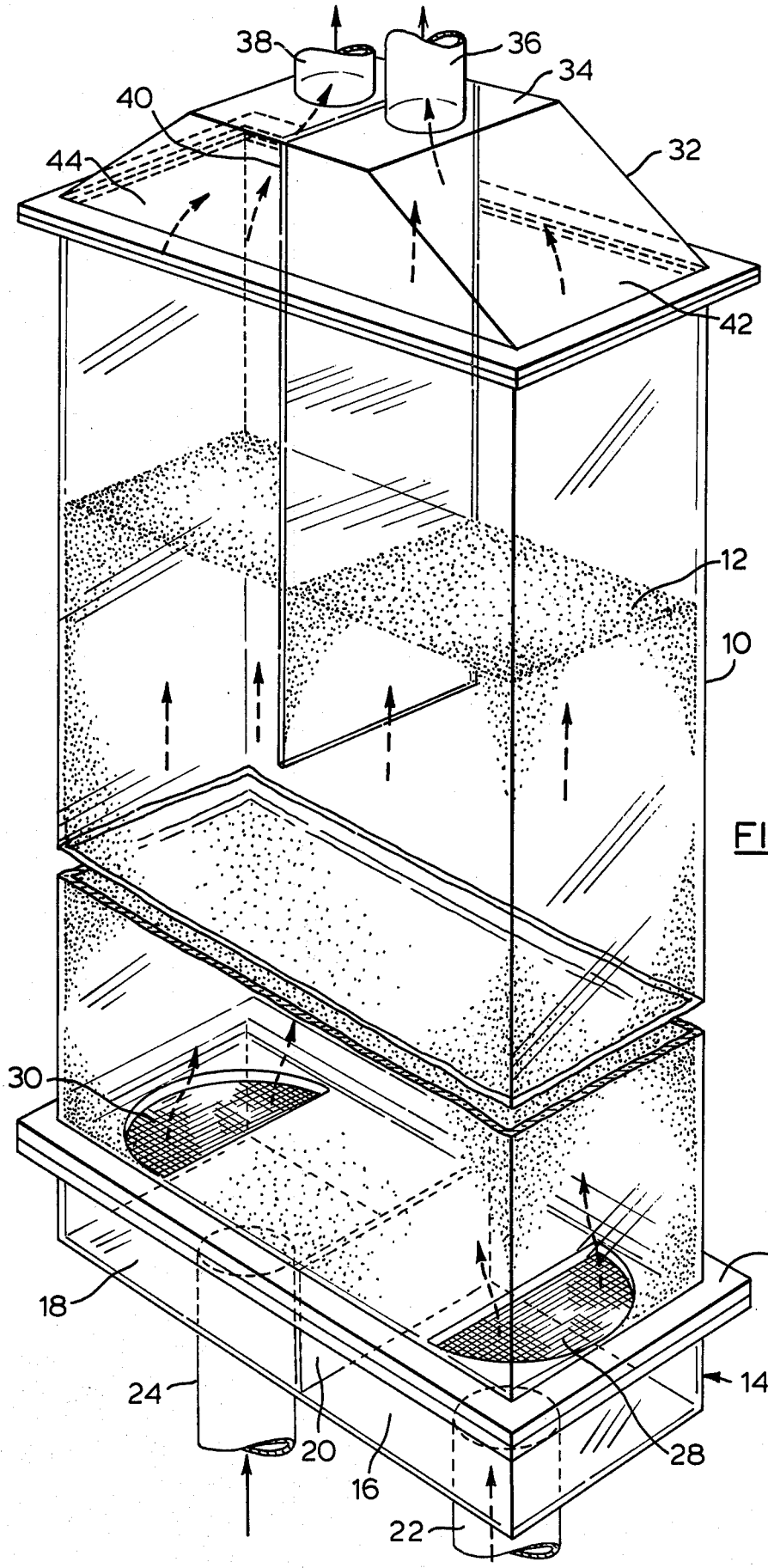
FIG. 1 is a perspective diagrammatic view, with parts cut away, of a fluidized bed apparatus according to the invention.

The apparatus as illustrated in FIG. 1 comprises a tall elongated rectangular section chamber 10, containing a mass of fluidizable particles 12, e.g. of sand, glass, coal etc., suitably chosen as regards size, nature, density, etc. for ready formation of a fluidized bed.

The bottom of the chamber 10 is sealingly secured to a rectangular section plenum chamber 14, which is vertically divided into two side by side portion 16, 18, by means of a substantially gas tight partition wall 20. A first inlet pipe 22 communicates with first portion 16 of the plenum chamber 14, and a second inlet pipe 24 communicates with second portion 18.

The boundary wall assembly 26 separating the main chamber 10 from the plenum chamber 14 is provided with a pair of semi-circular screened openings, the first of which 28 provides communication between portion 16 of plenum chamber 14 and the fluidized bed, and serves as a first inlet port, and the second of which 30 serves as a second inlet port, communicating between second portion 18 and the fluidized bed.

The top of the chamber 10 is sealing secured to an upper exit chamber 32 of pyramidal shape, the smaller uppermost wall 34 of which is provided with lead off exit pipes 36, 38. A vertically depending baffle plate 40 extends downwardly from the upper most wall 34, dividing the upper part of chamber 10 into first and second side by side upper zones 42, 44. The baffle plate 40 extends down the center of the chamber 10, into the fluidized bed 12, to a level below the top of the fluidized bed when in operation. The baffle plate 40 is in substantially gas-tight, sealing engagement with the side walls and top wall 34 of the chamber 10, so that the upper zones 42, 44 do not communicate laterally with one another. The lowermost edge of plate 40 is vertically aligned with the separation between inlet ports 28 and 30. The zones 42, 44 have respective first and second outlet ports 36, 38 communicating therewith. The depending baffle plate 40 extends downwardly about $\frac{1}{3}$ the vertical height of the fluidized bed chamber 10. Thus, free circulation of fluidized bed particles 12 is still allowed over the bottom approximate $\frac{2}{3}$ of the bed depth.

In operation of the apparatus, as a heat transfer device only, appropriately sized particles 12 of an inert material such as glass or sand are introduced into chamber 10. Hot gas is fed in through inlet pipe 22, a first portion 16 of plenum chamber 14 and first inlet port 28. Cool gas to be heated is similarly led in through inlet pipe 24, second portion 18 of plenum chamber 14 and second inlet pipe 30. The plenum chamber 14 serves to smooth out pressure fluctuations of the inlet gases. The flow rates are adjusted so as to obtain proper fluidization of the bed of particles 12 and to minimize the rate of gas transfer between sides of the bed. The hot gas moves vertically upwardly through a zone of the fluidized bed extending vertically upwardly from first inlet port 28 to first upper zone 42, to first outlet port 36. Similarly the cool gas moves vertically upwardly through a zone of the fluidized bed extending vertically upwardly from second inlet port 30 to second upper zone 44, to second outlet port 38. Free communication between the two zones of the bed is provided below the bottom extremity of baffle plate 40, so that turbulent flow of the fluidized bed particles 12 between the zones occurs, promoting heat transfer between the hot gas and the cool gas. However, mixing of the two gases does not occur to any significant extent.

Figure 2:
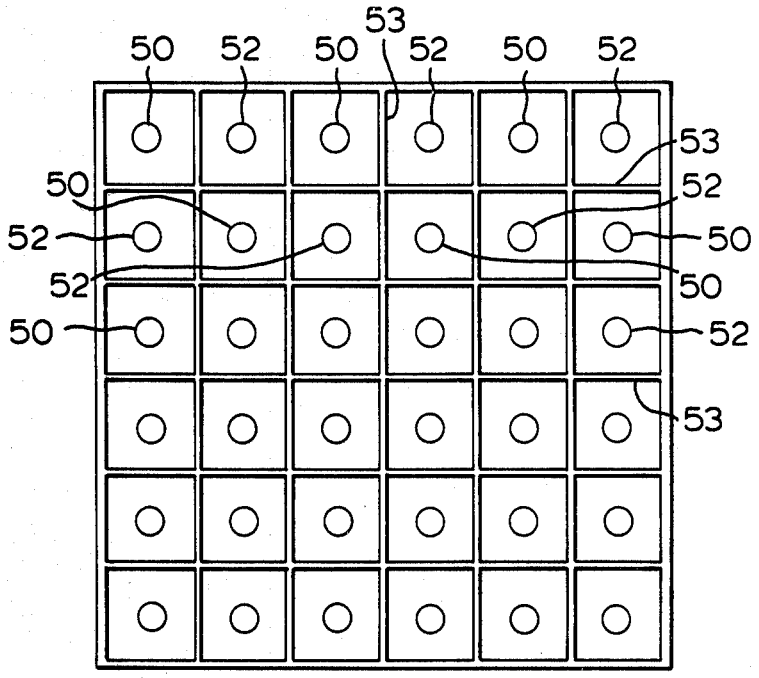
FIG. 2 is diagrammatic cross sectional view, looking downwardly, of an alternative inlet port and dividing baffle arrangement.

FIG. 2 shows a diagrammatic sectional view, taken on a horizontal section through an upper part of an appartus and looking downwardly, the appartus having an arrangement of fluidized bed upper zones and respective inlet ports according to the present invention, in which a plurality of hot and a plurality of cold streams of gas are used, for heat exchange purposes. The inlet ports and baffle plates are arranged in a square grid, each row of the grid having alternating first zones and inlet ports 50 for introduction of hot gas, and second zones and inlet ports 52 for introduction of cool gas, with baffles 53 extending downwardly into the bed, dividing the upper part of the chamber and portions of the bed into a plurality of non-communicating upper zones, as generally described with reference to FIG. 1. Each such zone has an upper outlet port. The next adjacent row similarly has alternating first zones and inlet ports 50, and second zones and inlet ports 52, but in staggered relationship to the first row, so that each first zone has adjacent to each of its four sides a second zone receiving the cool gas. Similarly, each second zone 52 is surrounded by four first zones. As in the embodiment described in FIG. 1, each first inlet port 50 has a lateral separation from each second port 52.

Figure 3:
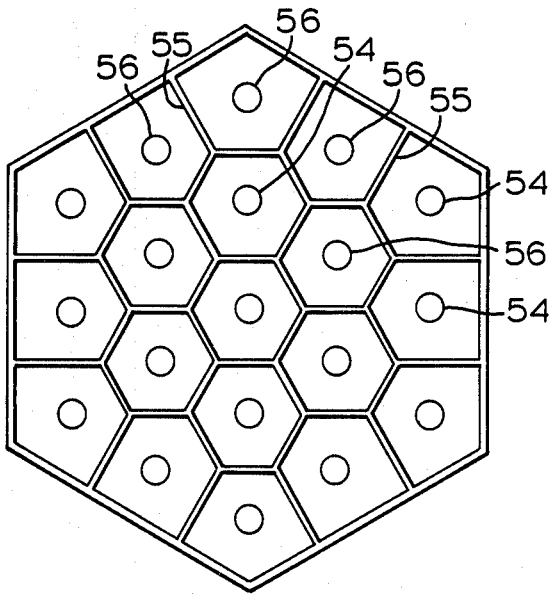
FIG. 3 is a diagrammatic cross sectional view, looking downwardly, of a further alternative inlet port and dividing baffle arrangement.

FIG. 3 shows a further alternative arrangement of upper zones and corresponding inlet ports, in diagrammatic sectional view as FIG. 2, but in which the first inlet ports 54, disposed below baffle plates 55 defining first upper zones as before, and receiving hot gases, are bounded by second inlet ports 56, receiving cooling gases, and disposed below baffle plates 55, similarly defining second upper zones, for heat transfer between the gas streams. A lateral separation between the respective first and second inlet ports is maintained. The baffle plates 55 extend downwardly into the fluidized bed, but leave substantial communication of solid particles in the respective zones below the lower extremity of the baffle plate as previously described. In this embodiment, the baffle plates 55 define essentially hexagonal zones. An upper arrangement of first and second outlet ports is provided, corresponding to the grid pattern shown in FIG. 3, so that a first outlet port is provided in an upper zone disposed vertically above each of the first inlet ports 54, and a second outlet port is provided in an upper zone disposed vertically above each of the second inlet ports 56. The hexagonal arrangement of zones allows each first zone, handling the hot gas, to be bounded by a second zone, handling the cool gas, on several of its sides and vice versa. In the embodiment shown in both FIG. 2 and FIG. 3, a fluidized bed chamber of substantial extent is provided, with depending baffle plates extending not more than about ½ the depth of the bed, so as to allow substantial free communication for circulation of particles between hot zones and cold zones of the bed, for efficient heat transfer purposes.

The apparatus according to the present invention provides simple and efficient heat transfer means, which can be operated with gases at high temperatures. The apparatus is compact in design, and provides a substantial capacity of heat exchange within a small volumetric unit.

In another modified form of apparatus according to the invention, automatic withdrawal and replenishment of the fluidized bed particles is undertaken. In the case of a combustible or reactive particle, such as coal particles in a coal combustion process according to the present invention, such replenishment is necessary if the process is to be conducted continuously for any substantial period of time. Automatic feed means to keep a constant quantity of particles in the bed may be undertaken. Continuous replenishment fluidized beds are well known in the art, and do not require detailed description herein.

It is within the scope of the present invention to provide a fluidized bed apparatus as defined, having additional internal structure such as additional baffles, grates, spheres, etc., to increase the streamlining of the particle flow and to enhance the heat transfer efficiency. Such additional internal structure should not interfere with the essential features of the apparatus according to the invention as previously defined, such as the free particle communication through the bed at levels below the dividing baffle plate or plates. Furthermore, a plurality of fluidized bed units, according to the invention may be provided, connected to one another in series, for example stacked one above the other, to maximize the heat transfer between the two gas streams passing successively through the unit. The apparatus according to the invention can be operated at substantially any chosen pressure with the equipment limitations. The particle sizes of the fluidized bed particles can vary over fairly wide limits, in accordance with known fluidized bed technology. The distance of lateral separation between the first and second inlet ports depends upon the overall size of the apparatus and the inlet ports and the like, but is preferably at least one centimeter, and most preferably five centimeters.

The invention is further described for illustrative purposes in the following specific example.

EXAMPLE

An apparatus as illustrated and described with reference to FIG. 1 was used, containing as fluidized bed particles glass beads of approximately ¼ mm diameter. The first inlet port 28 and the second inlet port 30 were both semi-circular, of diameter of about four inches. The side walls of the chamber 10 were of transparent material, to allow visual observations and measurements of the flow characteristics and behaviour of the bed in use. Through the first inlet was introduced carbon dioxide-free air, and through the second inlet was introduced air containing a known amount of carbon dioxide. The gases issuing from the respective first and second outlet ports were analysed by gas chromatography, so as to measure the amount of carbon dioxide present in the gas stream issued from the first inlet. From this measurement, the percentage of gas transfer was calculated. The flow rates of the two gas streams were kept the same as each other. The fluidized bed particle velocities at various locations in the bed were estimated by visual observations, on colored particles included in the bed, alongside measuring scales included on the walls of the vessel 10. The separation between the two inlet ports, the depth of the bed, the distance between the bottom of the baffle 40 and the bottom of the bed, and the flow rates were varied to obtain the results shown in the following table.

| Separation Between Inlet Ports (m) | Height Below Partition (m) | Height of Particle Bed (m) | Mean Flow Rate (l/m) | % Gas Transfer (mean) | Average Particle Velocities over Height of Bed (m/s) | | | |
|---|---|---|---|---|---|---|---|---|
| | | | | | 0.025 m from centre | 0.04 m from centre | 0.05 m from centre | 0.075 m from centre |
| 0.152 | 0.308 | 0.325 | 80.6 | 3.3 | — | — | — | — |
| 0.152 | 0.308 | 0.450 | 83.2 | 5.5 | — | — | — | — |
| 0.229 | 0.308 | 0.325 | 90.5 | 1.1 | — | — | — | — |
| 0.229 | 0.308 | 0.325 | 155 | 0.9 | — | — | — | — |
| 0.229 | 0.308 | 0.325 | 301 | 8.9 | — | — | — | — |
| 0.229 | 0.308 | 0.450 | 79.3 | 1.7 | — | — | 0.008 | 0.005 |
| 0.229 | 0.308 | 0.450 | 162 | 1.9 | 0.022 | 0.018 | 0.019 | — |
| 0.229 | 0.308 | 0.450 | 272 | 9.1 | 0.040 | 0.034 | — | 0.048 |
| 0.229 | 0.308 | 0.600 | 91.5 | 2.3 | — | — | — | — |
| 0.229 | 0.308 | 0.600 | 164 | 4.8 | 0.018 | 0.018 | 0.015 | — |
| 0.229 | 0.450 | 0.600 | 90.5 | 4.4 | — | 0.003 | 0.003 | 0.003 |
| 0.229 | 0.450 | 0.600 | 155 | 11.3 | — | 0.042 | 0.013 | 0.023 |
| 0.279 | 0.308 | 0.325 | 144 | 0.8 | — | — | — | — |
| 0.279 | 0.308 | 0.325 | 297 | 1.8 | — | — | — | — |
| 0.279 | 0.308 | 0.450 | 144 | 1.8 | — | — | — | — |
| 0.279 | 0.308 | 0.450 | 296 | 1.7 | 0.035 | — | 0.043 | 0.038 |

-continued

| Separation Between Inlet Ports (m) | Height Below Partition (m) | Height of Particle Bed (m) | Mean Flow Rate (1/m) | % Gas Transfer (mean) | Average Particle Velocities over Height of Bed (m/s) 0.025 m from centre | 0.04 m from centre | 0.05 m from centre | 0.075 m from centre |
|---|---|---|---|---|---|---|---|---|
| 0.279 | 0.450 | 0.600 | 168 | 2.8 | — | — | — | — |

These results indicate that only very small amounts of mixing of the two gas streams occur during the process, whilst substantial particle velocities are encountered in the fluidized bed, indicating efficiency of heat transfer between the gas streams. As is to be expected, the amount of gas mixing is influenced by the separation between the inlet ports, bed height, partition height and flow rate, and for a given apparatus of a certain size, routine adjustments of one or more of these variables need to be made, so as to optimise the process according to the invention.

It will be appreciated that many variations of the apparatus and process according to the invention can be adopted, whilst remaining within the scope and spirit of the invention. Thus, the process is adapted for use as a reactor apparatus as well as a heat transfer apparatus, with the fluidized bed particles being reactive or combustible. They may be of carbonaceous materials such as coal, coke, tar sand, oil shale, garbage, plastics materials or the like. In such combustion processes, the combustion gas may be air, optionally in admixture with another combustible gas such as methane, to cause exothermic reaction or combustion of the carbonaceous solid particles, accompanied by endothermic fuel gas producing reaction elsewhere in the bed. The apparatus can be used for a three-phase fluidization, in which the bed particles are mixed with oil, such a process being useful to hydrocrack and/or alkylate the oil. It can be used for producton of valuable fuels such as methanol and methane, by introduction through the second ports of a suitable reactant gas for reaction at high temperatures with the carbon. The scope of the invention is limited only by the appended claims.

What we claim is:

1. A fluidized bed apparatus for effecting heat transfer between a hot gas stream and a cooler gas stream, the apparatus comprising:

a chamber for receiving therein a mass of solid particles capable of forming a fluidized bed;

a first inlet port in the lower part of said chamber, for feeding the hot gas stream therein;

a second inlet port in the lower part of said chamber for feeding the cooler gas stream therein, the first inlet port and the second inlet port having a lateral separation;

an impervious dividing member extending downwardly from the top of the chamber part way into the fluidized bed of particles and dividing the upper portion of the chamber into first and second upper zones vertically aligned respectively with the first inlet port and the second inlet port;

a first outlet port in the first upper zone; and a second outlet port in the second upper zone.

2. The apparatus of claim 1 including a lower plenum chamber divided into two sections, into which the hot gas stream and the cold gas stream are introduced respectively, the sections of said plenum chamber communicating with the fluidized bed chamber via said first inlet port and said second inlet port.

3. Apparatus according to claim 1 wherein the first inlet port and the second inlet port have lateral separation of at least 1 cm.

4. Apparatus according to claim 3 including a plurality of first inlet ports and a plurality of second inlet ports, each in respective vertical registry with an upper zone having a respective first outlet port or a respective second outlet port, said inlet ports and upper zones as viewed in plan being arranged in a square grid arrangement with each first inlet port adjacent on each of its four sides with a second inlet port, and each first upper zone being adjacent on each of its four sides with a second upper zone.

5. Apparatus according to claim 3 including a plurality of first inlet ports and a plurality of second inlet ports, each of said first inlet ports and said second inlet ports being in vertical registry with the respective first upper zones and second upper zones, said inlet ports and upper zones as viewed in plan being arranged in a hexagonal arrangement with each first inlet port and respective first upper zone adjacent on its sides with a plurality of second inlet ports and respective second upper zones.

6. A process of effecting heat transfer between a first, hot gas stream and a second, cooler gas stream, utilizing a fluidized bed of particles, which comprises:

introducing the first gas stream into the bottom portion of the fluidized bed through a first inlet port;

introducing the second gas stream into the bottom portion of the fluidized bed through a second inlet port, said second inlet port being separated laterally from said first inlet port;

conducting the respective gas streams upwardly through respective upwardly extending, communicating zones of said fluidized bed, and into respective physically separated first and second upper zones thereof, the flow rates of the gas streams being adjusted so as to maintain fluidity and turbulent flow of the particles of the fluidized bed;

extracting the first gas stream from the fluidized bed through a first exit port located in the first separated upper zone; and extracting the second gas stream from the fluidized bed through a second exit port located in the second separated upper zone.

7. The process of claim 6 wherein the particles of the fluidized bed are inert to both the hot gas stream and the second, cooler gas stream, and are selected from the group consisting of sand, glass, alumina, silica, ferric oxide, calcium oxide and iron metal.

8. The process of claim 6 wherein the particles of the fluidized bed are carbonaceous particles, said first, hot gas stream comprising an oxygen containing gas stream, and said second gas stream comprising water vapour.

9. The process of claim 6 wherein the first, hot gas stream has a temperature of at least 500° C. at its time of passage through said first inlet port.

* * * * *